US005498078A

United States Patent [19]

Keller

[11] Patent Number: 5,498,078

[45] Date of Patent: Mar. 12, 1996

[54] MIXER FOR DOUBLE DISPENSING CARTRIDGES OR DISPENSING APPLIANCES

[76] Inventor: Wilhelm A. Keller, Obstgartenweg 9, CH-6402 Merlischachen, Switzerland

[21] Appl. No.: 372,916

[22] Filed: Jan. 13, 1995

[30] Foreign Application Priority Data

Jan. 19, 1994 [EP] European Pat. Off. ..... 94810031

[51] Int. Cl.[6] ..... B01F 5/06

[52] U.S. Cl. ..... 366/339; 222/145.6

[58] Field of Search ..... 366/178.1, 178.2, 366/178.3, 338, 339; 222/135–137, 145.5, 145.6, 459

[56] References Cited

U.S. PATENT DOCUMENTS

| | | | |
|---|---|---|---|
| 2,816,518 | 12/1957 | Daggett | 366/339 X |
| 4,168,018 | 9/1979 | Zahaykevich | 366/339 X |
| 4,370,304 | 1/1983 | Hendriks et al. | 366/338 X |
| 4,408,890 | 10/1983 | Beckmann | 366/339 X |
| 4,538,920 | 9/1985 | Drake | 222/137 X |
| 4,767,026 | 8/1988 | Keller et al. | 366/339 X |
| 4,995,540 | 2/1991 | Colin et al. | 222/137 X |
| 5,033,650 | 7/1991 | Colin et al. | 222/137 |
| 5,080,262 | 1/1992 | Herold et al. | 222/137 X |

FOREIGN PATENT DOCUMENTS

| | | |
|---|---|---|
| 0584428 | 3/1994 | European Pat. Off. . |
| 9207048 U | 9/1992 | Germany . |

*Primary Examiner*—Charles E. Cooley

[57] ABSTRACT

The mixer for double dispensing cartridges having two storage cylinders whose volumetric ratio is different from 1:1 comprises a mixer housing which is attachable to the cartridge, and a mixer element group arranged therein. The two contiguous dispensing openings of the cartridge communicate with an inlet portion which precedes the mixer element group, the inlet portion being divided into a larger inlet chamber for the first component having a greater dispensing volume and into a smaller inlet chamber for the second component having a smaller dispensing volume. The smaller inlet chamber is positioned and designed in such a manner that the first component envelops the second component at the outlet of the inlet chamber and the first edge of the first helix cuts both the first and the second component in half, and that the laterally entering second component is guided to the center of the mixer. Such a mixer allows an intimate mixture of the components without the need of previously dispensing a certain useless quantity in order to adjust the correct mixing ratio.

10 Claims, 3 Drawing Sheets

MIXER FOR DOUBLE DISPENSING CARTRIDGES OR DISPENSING APPLIANCES

BACKGROUND OF THE INVENTION

The present invention refers to a mixer for double dispensing cartridges or dispensing appliances having at least two storage cylinders whose volumetric ratio is different from 1:1, comprising a mixer housing which is attachable to the cartridge respectively the dispensing appliance, and a mixer element group arranged therein, the two contiguous dispensing openings of the cartridge resp. the dispensing appliance communicating with the inlet portion of the mixer element group. Such mixers are known e.g. from U.S. Pat. No. 4,538,920, and they have the function of intimately mixing the two components dispensed from the dispensing cartridges n order to prepare them for their application.

If the two storage cylinders of the dispensing cartridge have approximately identical volumes and also have approximately equal dispensing openings, no major problems are involved in mixing the two components from the start. If however the two storage cylinders have substantially different volumes—which is equivalent to different cross-sectional areas since the storage cylinders have the same length on account of manufacturing and operating conditions—and different dispensing openings, e.g. of a ratio of 10:1, there is a risk that the component from the larger storage cylinder fills up the mixer element group of the mixer at the beginning of the dispensing process and that the second component having a smaller volume is thus suppressed or subdued. In particular, in the inlet area, the larger partial flow "A" will press the smaller partial flow "B" against the wall of the mixing tube on the B side, where it is retarded by the wall friction and therefore subdued or suppressed by the larger A component and thus can only begin to flow after some time. In this initial phase, the partial flow A precedes, and a mixture according to the intended proportions cannot take place, so that the components cannot or only partially react with each other and their use results in defective bonds, joints, impressions, etc.

Since the second component is generally the hardener (catalyst) and a component mixture with an insufficient amount of hardener is useless, it is common practice, in order to stabilize the desired proportions of the partial flows, to dispense a certain quantity which is discarded before being able to start the actual application of the mixture. Besides the loss of component substance, these dispensed substances cannot harden and may cause disposal problems.

In European Patent Publication No. 0 584 428, a solution of this problem is suggested by first retaining the first, larger component in a chamber and by providing means for directing this first component to the inlet chamber of the second component and for carrying the latter along. Although this embodiment provided an improvement with respect to the state of the art, this solution results in an increased flow resistance due to several necessary restrictions of the cross-sectional area. This increased flow resistance may require a reinforcement of the cartridge walls and involves higher dispensing forces.

Furthermore, a dispensing appliance is known from European Patent Publication No. 472,448 in which the outlets of the dispensing appliance resp. of the cartridge housing are arranged in such a manner that the larger component flows around the smaller one and carries it along. The appliance is intended for use with or without a mixer. In the case where no mixer is used, the two components unite in the cartridge or in the dispensing appliance already, and because of the hardened substance, the outlet area must be cleaned after a cartridge exchange before continuing to work. If a mixer is used, the substance hardens there, and after exchanging the mixer, the work can be continued without cleaning the outlet area of the cartridge or of the dispensing appliance. However, in the above appliance, no measures are taken to ensure an exact mixing ratio.

SUMMARY OF THE INVENTION

On this background, it is the object of the present invention to provide a mixer in which the components dispensed side by side are guided in the inlet portion in such a manner that the two components flow against the first mixer element in such a way that a good mixture is guaranteed from the beginning and that no increased flow resistance exists in front of the first mixer element group. This object is attained by a mixer wherein the inlet portion in front of the mixer element group is divided into a larger inlet chamber for the first component having a greater dispensing volume and into a smaller inlet chamber for the second component having a smaller dispensing volume, and wherein the smaller inlet chamber is arranged and designed in such a manner that the first component envelops the second component at the outlet of the inlet chamber and that the first inlet edge of the first helix cuts both the first and the second component in half.

BRIEF DESCRIPTION OF THE DRAWINGS

The invention will be explained in more detail hereinafter with reference to a drawing of embodiments.

DETAILED DESCRIPTION OF THE INVENTION

In prior art mixers, the components are randomly supplied to the first helix of the mixer, the mixer element group being designed in such a manner that the two components are well mixed across the mixer until the dispensing end. As mentioned in the introduction, in known mixers having different volume ratios resp. cross-sectional ratios of the storage cylinders, it occurs that the substance having a larger volume suppresses or subdues the substance having a smaller volume, particularly in the initial phase, i.e. when the mixing tube is being filled up, so that the prescribed mixing ratio cannot be obtained. After a certain time, i.e. when the mixer is completely filled and a certain amount has been dispensed, the mixing ratio of the partial flows stabilizes at a predetermined value.

Figure 1:
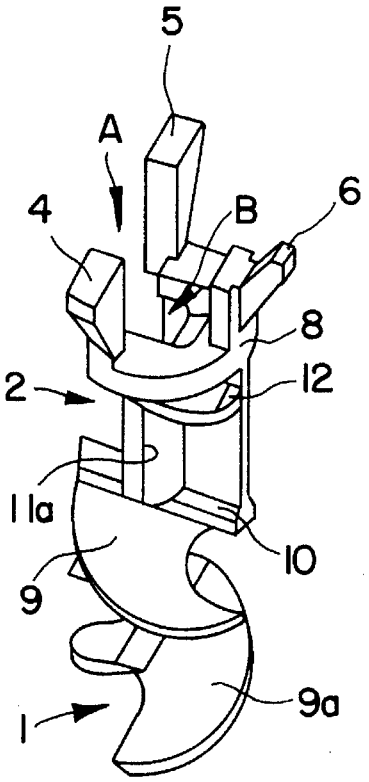
FIGS. 1, 1*a*, and 2 show a first embodiment of the invention in a perspective view.
Figure 1A:
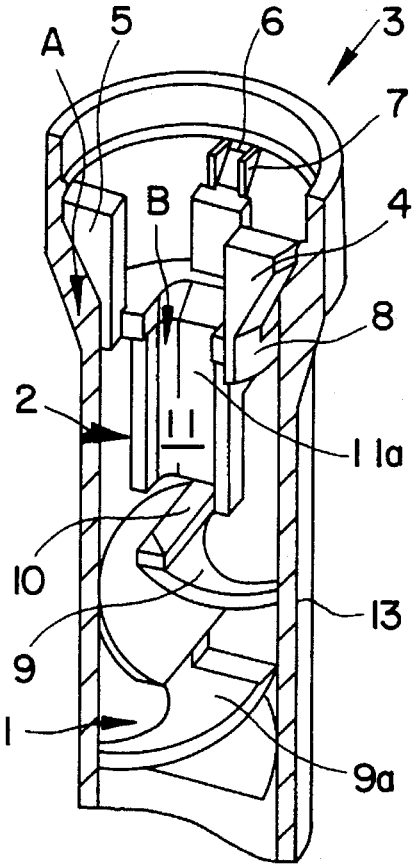
Figure 2:
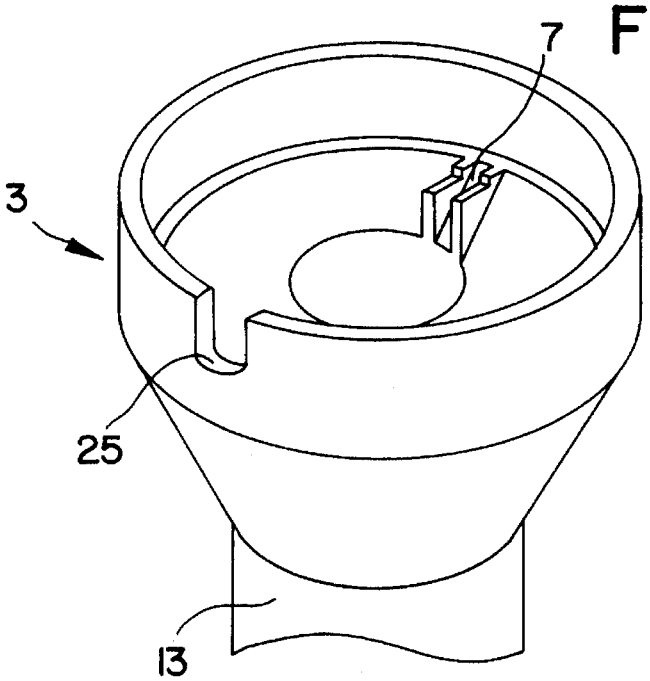

FIGS. 1 and 1*a* show the inlet portion 2 and the upper part of mixer element group 1 in perspective views, and FIG. 2 shows the inlet of mixer housing 3. Inlet portion 2, which fits into mixer housing 3, comprises an aligning and guiding projection 6 which fits into a corresponding guide groove 7 of mixer housing 3 and which guides partial flow B, in addition. In order to orient the mixer with respect to the cartridge or the dispensing appliance, the inlet portion may either comprise two aligning portions 4 and 5, as shown in FIG. 1, which cooperate with the outlet of the cartridge or the dispensing appliance, or the mixer housing may comprise a recess 25 which cooperates with a corresponding projection of the cartridge or the dispensing appliance.

The smaller component B is supplied from the cartridge outlet resp. from the dispensing appliance to channel 11, while the larger component A occupies the remainder of the available volume of the inlet portion. The shape and the position of the channel cause component A to entirely envelop component B at the beginning of the first helix 9. Furthermore, FIG. 1*a* shows that the roof-shaped edge 10 where the first helix begins, is located exactly in the center of the channel 11 for the smaller component B and divides partial flow A as well as partial flow B in half. Blind flange 8 corresponds to the clear width of mixing tube 13 and may possibly comprise a sealing bead. Below the blind flange, on the opposite side of the inlet of component A, an inclined guiding surface 12 is provided which prevents the accumulation of possibly present air or gas and thus ensures a good air evacuation and prevents the formation of air bubbles in the substance.

By the precise alignment of both partial flows with respect to edge 10 of the first helix 9, which also extends behind the end wall 11*a* of channel 11, and by the fact that component B is surrounded by component A, a precise mixing ratio and thus an optimal mixture of the two components is obtained from the first helix 9 on to the second helix 9*a* and further, and any suppression of component B is prevented. Furthermore, the cross-sectional areas of the two partial flows in the area between the blind flange and the edge are designed to approximately correspond to the mixing ratio.

In FIGS. 3 to 6, a second embodiment is represented in which the channel for the smaller component B is completely enclosed. Since this is also a mixer for a double cartridge having adjacent storage cylinders, the outlet B of the cartridge and the inlet of the mixer for the smaller component B is not disposed in the center but laterally displaced. For an optimal envelopment of component B by component A, it is particularly advantageous to direct component B to the center of the mixing tube.

Figure 3:
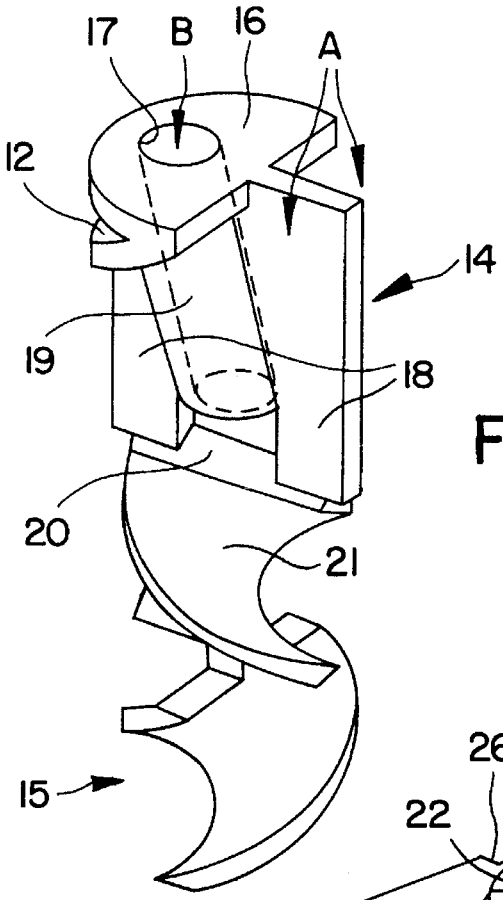
FIGS. 3 and 4 show a second embodiment of the invention in a perspective view, FIG. 4 being a partial longitudinal section.

In FIG. 3, inlet portion 14 with the following mixer element group 15 is shown in a perspective view. On the B side, the inlet portion is sealed by a blind flange 16 which comprises an opening 17 for the smaller component B, while the larger component A flows into the inlet portion on the side of blind flange 16. When the mixer is connected to the cartridge, cartride outlet 22 is sealingly pressed against blind flange 16. Wall 18 is arranged perpendicularly to blind flange 16 and serves the purpose of centering and stabilizing the inlet portion in the mixer housing. In this embodiment as well, an inclined guiding surface 12 is provided below blind flange 16 on the opposite side of the inlet of component A in order to obtain a good air evacuation.

In contrast to channel 11 of the previous embodiment, channel 19 for the smaller partial flow B is closed on all sides. Channel 19 is oblique with respect to the longitudinal axis of the mixer, see also FIG. 4, and ends in the center of the mixing tube. Adjacent the channel end, roof-shaped edge 20 of the first helix 21 is arranged, which divides the partial flow B in two halves in order to provide good conditions for a correct mixture. The first mixer element need not comprise an edge 10 or 20, and the latter need not be roof-shaped.

Figure 5:
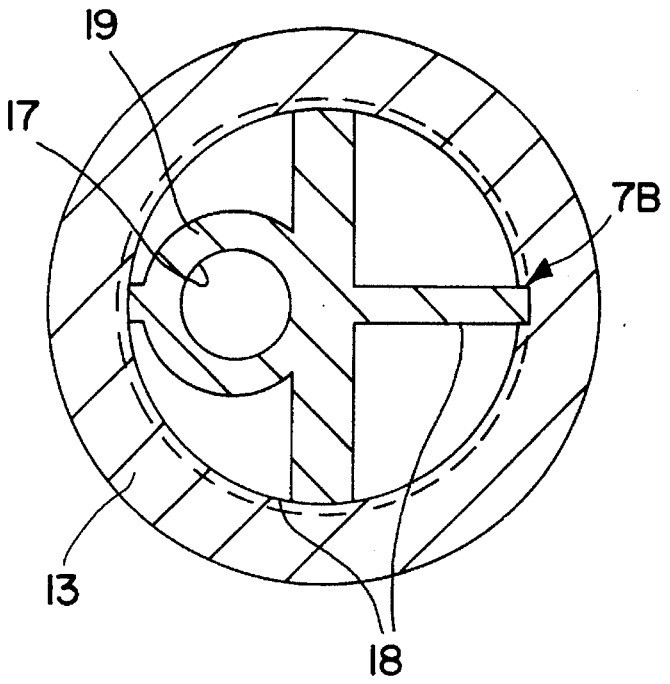
FIG. 5 shows a cross-section according to line V—V in FIG. 4.
Figure 6:
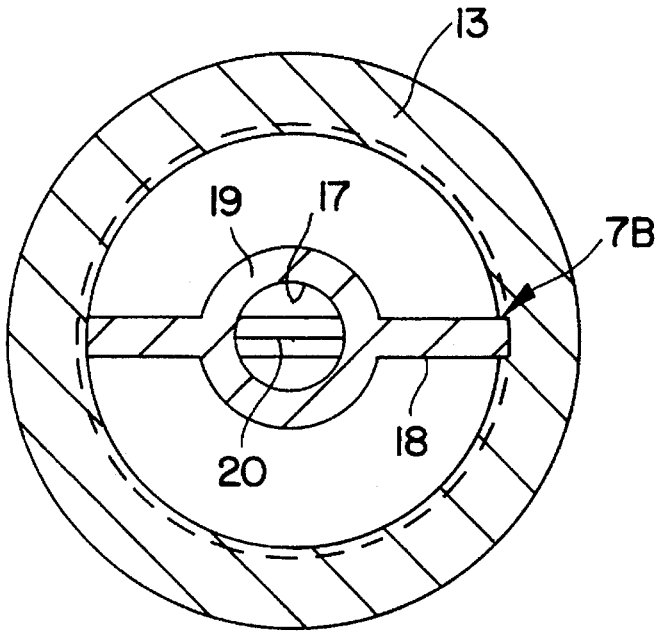
FIG. 6 shows a cross-section according to line VI—VI in FIG. 4.

Mixer housing 3B represents an alternative of the mixer housing according to FIG. 2 and is attached to the cartridge housing resp. to the dispensing appliance by means of a bayonet attachment comprising a guide groove 7B, see FIG. 5, matching wall 18 on the A side. The edge of the bayonet flange comprises a recess 26 which serves to align the mixer with the cartridge of the dispensing appliance.

Figure 4:
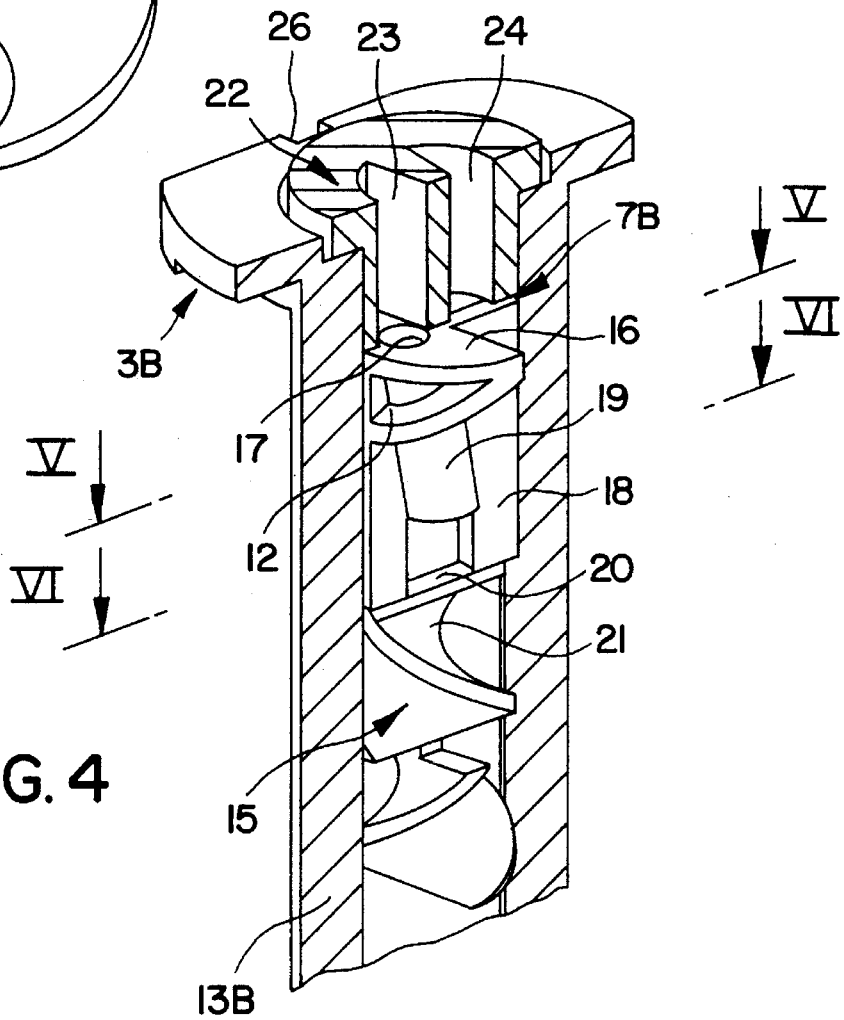

In FIG. 4, a cutaway view of mixer housing 3B is shown in which the outlet 22 with the two dispensing openings 23 and 24 of the double cartridge resp. the dispensing appliance is illustrated. In the two cross-sections of FIG. 5 and 6 it appears that channel 19 leads to the center of mixing tube 13B.

It follows from the above description that the dispensing openings of the dispensing cartridge or of the dispensing appliance must correspond to the inlet openings of the mixer, and that it is necessary to take measures ensuring that the mixer is attached thereto in the correct position, particularly if the volumetric ratio and the ratio of the openings of the two storage cylinders are different from 1:1, as is the case in the present application. Different additional measures to this end have been described in European Patent Application No. 92810645.9 mentioned in the introduction. The same applies for the attachment of the mixer of the present invention to a mixer connector of dosing and proportioning installations.

The mixer of the invention ensures an efficient and optimal mixing process. In this arrangement, the possible occurrence of slight phase shifts or pulsations between components A and B, which are caused by different influences such as different elasticities of the two cartridge cylinders, are largely compensated by the improved balancing and remixing effect of the static mixer. In this context, of course, it must be ensured that the cross-sectional areas of the partial flows are proportioned in such a manner that the two partial flows are supplied to the first helix at the same time.

I claim:

1. A mixer for double dispensing cartridges or dispensing appliances having at least two storage cylinders whose volumetric ratio is different from 1:1 and whose components are dispensed side by side, comprising:

a mixer housing which is attachable to a dispensing appliance having components dispensed side by side, and a mixer element group arranged in said mixer housing and having an inlet portion with side by side inlets adapted to communicate with two contiguous dispensing openings of a dispensing appliance, wherein the inlet portion of the mixer element group is divided into a larger inlet chamber for a first component having a greater dispensing volume and into a smaller inlet chamber for a second component having a smaller dispensing volume, and wherein the smaller inlet chamber is arranged and designed in such a manner that the first component envelops the second component at an outlet of the smaller inlet chamber and that a first inlet edge of a first helix cuts both the first and the second component in half as said first and second components exit said inlet chambers.

2. The mixer of claim 1, wherein the smaller inlet chamber is in the shape of a channel which ends in a center of the mixer element group in front of the first helix.

3. The mixer of claim 2, wherein the channel is open on a side of the first component.

4. The mixer of claim 2, wherein the channel is in the shape of a closed tube.

5. The mixer of claim 1, wherein the volumes of the inlet chambers are proportioned in such a manner that flows of the first and second components are supplied to the first helix at the same time.

6. The mixer of claim 1, wherein on a side opposite an inlet of the larger inlet chamber, the larger inlet chamber comprises means to prevent the inclusion of air bubbles in a flow of the first component.

7. The mixer of claim 1, wherein the inlet portion and the mixer housing comprise means for aligning the inlet portion including the mixer element group in the mixer housing.

8. The mixer of claim 1, further comprising means for aligning the mixer to a dispensing appliance.

9. A mixer for a dispensing appliance having components dispensed side by side, comprising:

a tubular, elongated mixer housing adapted to be attached to a dispensing appliance;

a mixer element group arranged in said mixer housing and having an inlet portion with side by side inlets adapted to communicate with two contiguous dispensing openings of a dispensing appliance;

the inlet portion of the mixer element group being divided into a larger inlet chamber for a first component having a greater dispensing volume and a smaller inlet chamber for a second component having a smaller dispensing volume; and the smaller inlet chamber comprising a channel angled with respect to a central longitudinal axis of said mixer element group, said channel having an inlet for receiving the second component from the dispensing appliance and an outlet for introducing the second component into a mixing helix of said mixer element group, said inlet being offset from said central longitudinal axis and said outlet being generally concentric with said central longitudinal axis;

said mixing helix having a first helix with a first inlet edge, said first inlet edge being arranged to cut both the first and second components in half as said first and second components exit said inlet chambers, said outlet of said channel being arranged such that the first component envelops the second component as said components reach the first inlet edge of said first helix.

10. In combination, a dispensing appliance having two components dispensed side by side and a mixer for mixing the dispensed components, comprising:

a dispensing appliance having a generally cylindrical outlet with two side by side dispensing openings;

a tubular, elongated mixer housing attached to said outlet of said dispensing appliance in fluid communication with said dispensing openings; and a mixer element group arranged in said mixer housing and having an inlet portion with side by side inlets positioned in fluid communication with said dispensing openings of said dispensing appliance;

the inlet portion of the mixer element group being divided into a larger inlet chamber for a first component having a greater dispensing volume and a smaller inlet chamber for a second component having a smaller dispensing volume, the smaller inlet chamber comprising a channel angled with respect to a central longitudinal axis of said mixer element group, said channel having an inlet for receiving the second component from the dispensing appliance and an outlet for introducing the second component into a mixing helix of said mixer element group, said inlet of said channel being offset from said central longitudinal axis and said outlet of said channel being generally concentric with said central longitudinal axis;

said mixing helix having a first helix with a first inlet edge, said first inlet edge being arranged to cut both the first and second components in half as said first and second components exit said inlet chambers, said outlet of said channel being arranged such that the first component envelops the second component as said components reach the first inlet edge of said first helix.

* * * * *